United States Patent [19]

Dennis

[11] Patent Number: 4,911,418

[45] Date of Patent: Mar. 27, 1990

[54] WORK HOLDER

[76] Inventor: Donald B. Dennis, 2307 Old Lewis Rd., Johnson City, Tenn. 37602

[21] Appl. No.: 276,300

[22] Filed: Nov. 25, 1988

[51] Int. Cl.[4] ..... B66F 3/00

[52] U.S. Cl. ..... 269/71

[58] Field of Search ..... 269/71, 45, 73, 60, 269/76, 905, 904, 909, 17

[56] References Cited

U.S. PATENT DOCUMENTS

| | | | |
|---|---|---|---|
| 2,538,640 | 1/1951 | Click | 269/71 |
| 3,148,873 | 9/1964 | Chandler | 269/71 |
| 4,183,511 | 1/1980 | Marek | 269/71 |
| 4,530,492 | 7/1985 | Bork | 269/71 |
| 4,564,178 | 1/1986 | Steffe | 269/133 |
| 4,729,552 | 3/1988 | Pempek | 269/71 |

OTHER PUBLICATIONS

Barker, J. B., AT&T Technical Digest, "Fixture for Holding Boards", No. 78, Jul. 1986.

*Primary Examiner*—Robert C. Watson

[57] ABSTRACT

A work holder having substantially universal workpiece positioning capability having a base, a turret having first and second members pivotally connected and pivotally mounted on the base by a cooperating bearing on the base and first member, the turret being pivotal 360° with respect to said base means in a first plane, the second member being pivotal in other planes normal to the first plane, a worktable on the second member for contacting a workpiece in a supporting position, and a first clamp mechanism on the second member for exerting retaining force in a direction substantially parallel to the first plane on a workpiece supported on the worktable.

13 Claims, 2 Drawing Sheets

WORK HOLDER

This invention concerns devices for positioning and holding workpieces at a work station whereby the mechanic, machinist, technician or the like can test, repair or reconstruct the workpiece in a convenient and comfortable manner. The invention especially relates to a holder for items such as security safe doors, round or rectangular, whereby the door is positionable in a universal manner such that complex mechanical operations such as combination changing or dial replacement can be performed thereon, either from the front, back or sides, from substantially any angle or posture without any fear of the door shifting or falling and without the need for any hand-holding of the door.

The field of work holders is of course replete with devices for holding various types of workpieces, however, Applicant is unaware of any prior art on work holders which can accommodate safe doors, particularly heavy, and cumbersome round ones. U.S. patents which show various devices for supporting workpieces other than safe doors are exemplified by the following: 4,183,511; 518,750; 1,460,344; 2,188,433; 2,353,891; 2,400,862; 2,569,620; 2,955,632; 3,043,587; 3,053,557; 3,170,683; 3,301,547; 3,595,556; 4,029,308; 4,221,368; 4,239,197; and 4,729,552. These prior devices, many of which are heavy, cumbersome and complex, are incapable of positioning in a universal directional and convenient manner, safe doors, especially round safe doors, such that the necessary complex and tedious mechanical operations can be performed on them in reasonable comfort.

A principal object therefore of the present invention is to provide a holding or supporting device which is light weight, easily transportable and attachable to a work station, and readily adaptable to holding in a sturdy manner a wide variety of workpieces such that they can be positioned at nearly any angle for ease of repair, reconstruction, assembly or the like.

This and other objects hereinafter appearing have been attained in accordance with the present invention through the construction of a work holder having substantially universal workpiece positioning capability comprising base means, turret means comprising first and second members pivotally connected and pivotally mounted on said base means by cooperating bearing means on said base means and first member, said turret means being pivotal 360° in a first plane substantially parallel to said base means, said second member being pivotal in other planes normal to said first plane, worktable means on said second member for contacting a workpiece in a supporting position, and first clamp means on said second member for exerting retaining force in a direction substantially parallel to said first plane on a workpiece supported on said worktable means.

In certain preferred embodiments:

The said first clamp means is adjustable in both horizontal and vertical directions with respect to said worktable for accommodating varying sizes and configurations of workpieces;

The said worktable comprises spaced segment means between, through and by which the lower portions of a curved workpiece can extend and be supported; and The work holder is provided with upright means on said second member of said turret means extending upwardly generally normal to said base means, and second clamp means is mounted on said upright means for exerting retaining force in a direction substantially parallel to said first plane on a workpiece supported on said worktable means.

The invention and additional objects will be further understood from the following description and drawing wherein.

Figure 1:
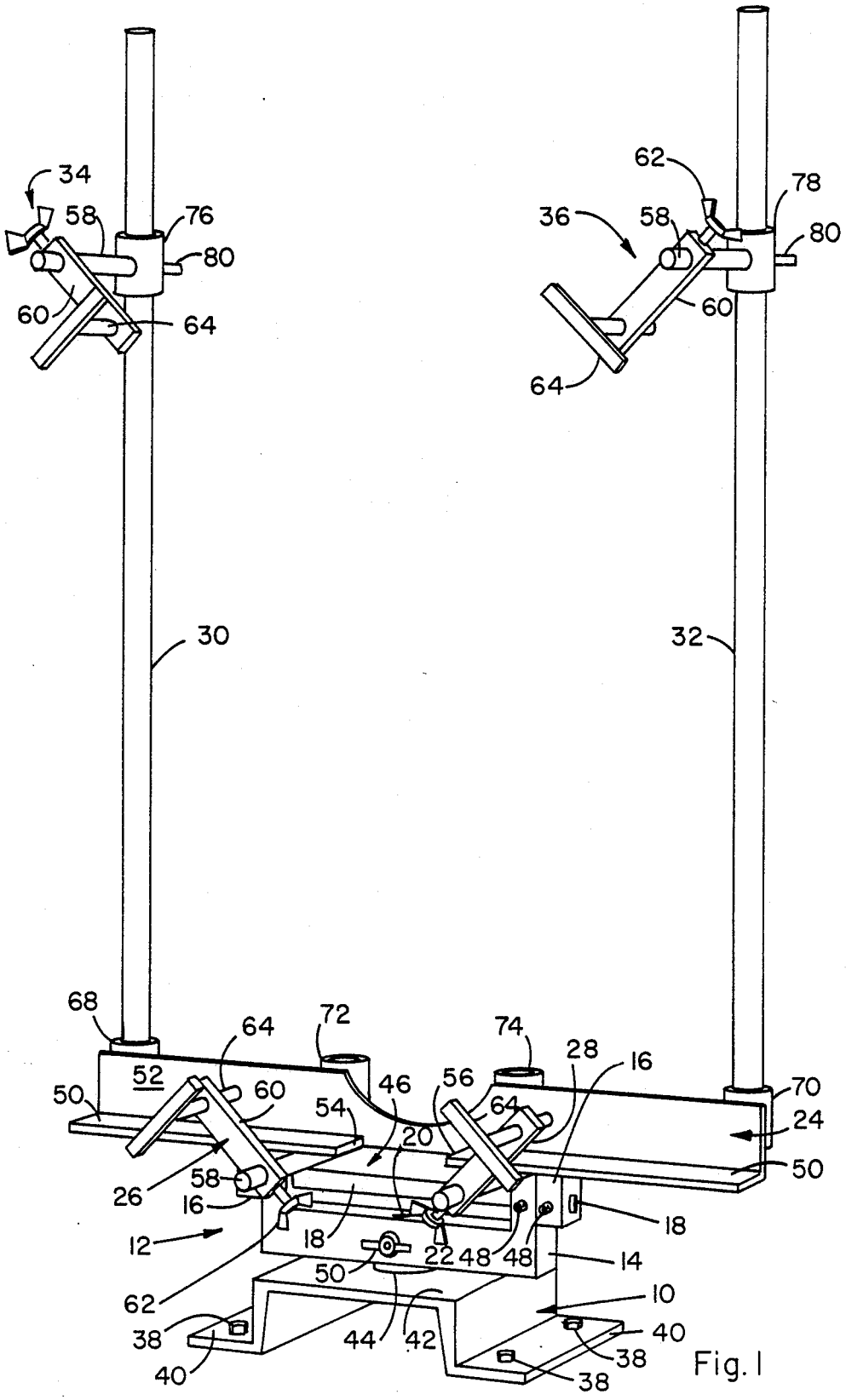
FIG. 1 is an isometric view of a preferred embodiment of the work holder.

Referring to the drawing and with reference to the claims hereof, particularly claims 1 and 8, the work holder comprises base means 10, turret means 12 comprising first and second members 14 and 16 respectively pivotally connected by pin 18 and pivotally mounted on said base means by cooperating bearing means 20, 22 on said base means and first member, said turret means being pivotal 360° on said base means in a first plane, said second member being pivotal in other planes normal to said first plane, worktable means generally designated 24 on said second member for contacting a workpiece such as 66 in a supporting position, and first clamp means generally designated 26 and 28 on said second member for exerting retaining force in a direction substantially parallel to said first plane on a workpiece supported on said worktable means.

In a further preferred embodiment, upright means 30 and 32 are provided on said second member of said turret means extending upwardly generally normal to said base means, and second clamp means 34 and 36 are mounted on said upright means for exerting retaining force on a workpiece supported on said worktable means in a direction substantially parallel to said first plane.

In more specific terms, the base 10 may be of a section of flanged channel iron as shown, or may be of other shapes, or a solid block. The structure as shown allows easy installation onto a work bench, shelf, or the like by means of bolts or screws 38 through flanges 40. The bearing means 20, 22 represent, respectively, a shaft affixed to the top 42 of the base and extending upwardly through the aperture or bearing 22 in member 14. These elements can be reversed in position, i.e., the shaft 20 could be affixed to member 14 and pivotally mounted in suitable bearing means in the base. Suitable friction reducing means such as washer 44 may be interposed between member 14 and the base to allow easy pivoting, especially important for heavy workpieces such as safe doors.

Member 14 is shown with a center cut-out, however, it may be of solid construction. On the other hand, pin 18 need not be the full length of the members and the cut-out in member 14 could be deeper to allow further access of a round safe door through the opening 46 in the worktable. Suitable set screws 48 or the like threadedly mounted in member 14 and 16 may be used to fix the pivot angle between the members after the worktable and workpiece are pivoted to the desired position. Likewise, a set screw 50, preferably welded to a wing nut is threadedly mounted in member 14 to bear against shaft 20 and lock members 14 and 16 in a desired pivoted position.

The worktable 24 is preferably of angle iron having its interior surfaces 50 and 52, when the worktable is in a non-tilted position, lying in planes substantially parallel and vertical respectively to the pivot plane of the turret member 14 on the base. This angle iron is affixed by welding, brazing or other means to members 16, or is formed by casting, integrally therewith. The surface or side 50 of the worktable is preferably cut out to provide a gap 46 through which the lower portion of a circular or curved workpiece can fit and bear against and be supported by shoulders 54 and 56 to give added positional stability thereto upon being clamped in place.

Figure 2:
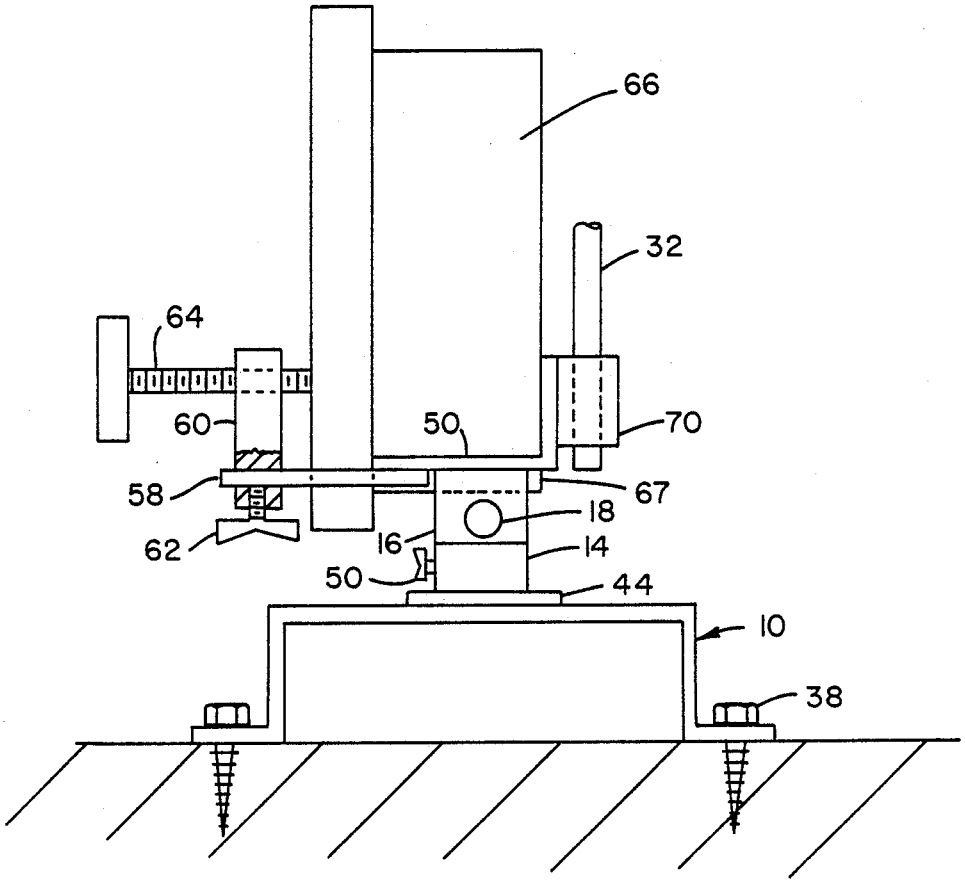
FIG. 2 is a side view of the holder with a round safe door in position.

The first clamp means 26 and 28 are each comprised of a rod 58 welded or otherwise affixed to the angle iron side 50 and extending outwardly therefrom a sufficient distance to allow a large inward or outward adjustment or positioning of arm 60 which is slidably, pivotally mounted thereon. A wing nut type set screw 62 threadedly mounted at any convenient location in the arm and adapted to bear against rod 58 provides a means for locking the arm in its adjusted position on the rod. A thumb screw, bolt, or the like 64 threadedly mounted in the arm provides a holding or clamping force against the surface of a workpiece such as a circular safe door as shown in FIG. 2. It is noted that the term "clamp means" as used herein means any type and number of clamps such as shown by 26 and 28.

In order to accommodate large workpieces such as tall, heavy, floor mounted safe doors, a pair or more of upright rods 30 and 32 are mounted, preferably slidably adjustable and lockable by set screws threadedly mounted in bushings 68 and 70 or 72 and 74 which are affixed by welding or the like to side 52 of the angle iron table. Second clamp means 34 and 36 of a similar construction and numbering to the first clamp means 26, 28 are provided on bushings 76 and 78 slidably mounted on rods 30 and 32 rods respectively and lockable into adjusted positions thereon by wing nut type set screws 80 or the like. It is noted that these first and second clamp means have, by virtue of their own structure, or in combination with other elements of the work holder, universal position clamping capabilities.

In the operation of the present work holder with reference to the difficult-to-hold circular safe door 66, the door is mounted on edge on the worktable with its lower portion 67 extending into the gap 46 and bearing against shoulders 54, 56. These shoulders, in addition to preventing rolling of the door on the worktable, position the door centrally of the worktable such that undue tilting stress is not placed thereon. The first clamp means 26, 28 are then properly positioned with respect to some flat surface on the door face or back and the screws 64 tightened there against. Through adjustable pivoting on bearing means 20, 22 and pin 18 the portions of the door on which a mechanical operation is to be performed can be brought or presented to the technician for easy and convenient viewing.

The invention has been described in detail with particular reference to preferred embodiments thereof, but it will be understood that variations and modifications will be effected within the spirit and scope of the invention.

I claim:

1. A work holder having substantially universal workpiece positioning capability comprising base means, turret means comprising first and second members pivotally connected and pivotally mounted on said base means by cooperating bearing means on said base means and first member, said turret means being pivotal 360° in a first plane with respect to said base means, said second member being pivotal in other planes normal to said first plane, worktable means on said second member for contacting a workpiece in a supporting position, said worktable means having spaced segment means between, through and by which the lower portions of a curved workpiece can extend and be supported, and first clamp means on said second member for exerting retaining force in a direction substantially parallel to said first plane on a workpiece supported on said worktable means, wherein said first clamp means is adjustable in both horizontal and vertical directions with respect to said worktable means for accommodating varying sizes and configurations of workpieces.

2. The work holder of claim 1 wherein said worktable means is in the form of an elongated angle iron member having, in its non-tilted position, one of its interior surface lying in a plane substantially parallel to said first plane, and having the other of its interior surfaces lying in a plane substantially normal to said first plane.

3. The work holder of claim 2 wherein said worktable means comprises spaced segment means between, through and by which the lower portions of a curved workpiece can extend and be supported.

4. The work holder of claim 3 wherein said first clamp means is adjustable in both horizontal and vertical directions with respect to said one interior surface of said angle iron member.

5. The work holder of claim 4 wherein said first clamp means is adjustable toward and away from the other of said interior surfaces of said angle iron member.

6. The work holder of claim 1 wherein upright means is provided on said second member of said turret means extending upwardly substantially normal to said base means, and second clamp means is mounted on said upright means for exerting retaining force in a direction substantially parallel to said first plane on a workpiece supported on said worktable means.

7. The work holder of claim 6 wherein said second clamp means is linearly adjustable on said upright means and positionable 360° about the axis thereof.

8. The work holder of claim 7 wherein said second clamp means is also positionable 360° in planes substantially parallel to the axis of said upright means.

9. The work holder of claim 5 wherein said first clamp means comprises rod means extending outwardly from said angle iron member in a plane substantially parallel to the plane of said one interior surface of said angle iron member and substantially normal to the other interior surface of said angle iron member, bar means pivotally and linearly slidably mounted at one end on said rod means, screw means threadably mounted in the other end of said bar means and adjustable toward and away from said other interior surface, and locking means on said bar means for locking the same in an adjusted rotational and linear position on said rod means.

10. The work holder of claim 8 wherein said first clamp means comprises rod means extending outwardly from said angle iron member in a plane substantially parallel to the plane of said one interior surface of said angle iron member and substantially normal to the other interior surface of said angle iron member, bar means pivotally and linearly slidably mounted at one end on said rod means, screw means threadably mounted in the other end of said bar means and adjustable toward and away from said other interior surface, and locking means cooperating with said rod means and bar means for releasable locking said bar means in an adjusted rotational and linear position on said rod means.

11. The work holder of claim 10 wherein said second clamp means comprises second rod means pivotally and slidably mounted on and extending outwardly from said upright means in a plane substantially normal to the axis thereof, second bar means pivotally and linearly slidablee mounted at one end on said second rod means, screw means threadedly mounted in the other end of said second bar means and adjustable toward and away from said upright means, and locking mens cooperating with said second rod means and second bar means for releasably locking said second bar means in an adjusted rotational and linear position on said second rod means.

12. The work holder of claim 5 wherein lock means is provided for releasable locking said turret means in a rotational position on said base means.

13. The work holder of claim 11 wherein lock means is provided for releasably locking said turret means in a rotational position on said base means.

* * * * *